US006732384B2

(12) United States Patent
Scott

(10) Patent No.: US 6,732,384 B2
(45) Date of Patent: May 11, 2004

(54) PUMP AUGMENTED URINE COLLECTOR

(76) Inventor: Barbara Scott, 1472 La Playa St., #3, San Francisco, CA (US) 94122-2823

( * ) Notice: Subject to any disclaimer, the term of this patent is extended or adjusted under 35 U.S.C. 154(b) by 0 days.

(21) Appl. No.: 10/152,964

(22) Filed: May 22, 2002

(65) Prior Publication Data

US 2004/0068780 A1 Apr. 15, 2004

(51) Int. Cl.[7] ..... A47K 11/12

(52) U.S. Cl. ..... 4/144.3; 4/144.1; 604/317; 604/349

(58) Field of Search ..... 4/114.1, 144.1, 4/144.3; 604/317, 349

(56) References Cited

U.S. PATENT DOCUMENTS

| | | | | | |
|---|---|---|---|---|---|
| 3,533,109 | A | * | 10/1970 | Kishimoto | 4/144.1 X |
| 4,202,058 | A | * | 5/1980 | Anderson | 4/144.3 |
| 4,631,061 | A | * | 12/1986 | Martin | 4/144.1 X |
| 5,701,612 | A | * | 12/1997 | Daneshvar | 4/144.3 |
| 6,007,526 | A | * | 12/1999 | Passalaqua | 604/349 |
| 6,493,883 | B2 | * | 12/2002 | Jones | 4/144.1 |
| 2002/0087131 | A1 | | 7/2002 | Wolff et al. | |
| 2002/0092089 | A1 | | 7/2002 | Jones | |

OTHER PUBLICATIONS

Web pages for Freshette feminine urinary director. 6 page. Printed from freshette.com. First viewed by applicant on Jul. 22, 2002. Web site content shows copyright 2001.

Web pages for Restop disposable travel toilet. 5 pages. Printhead from whennaturecalls.com. First viewed by applicant on Jul. 22, 2002. Web site shows no date.

* cited by examiner

*Primary Examiner*—Robert M. Fetsuga

(57) ABSTRACT

A urine collector is comprised of a container with an electric suction pump. A hose extending from the pump is connected to a funnel for collecting urine. The funnel is comprised of an interchangeable female or male funnel. The female funnel is comprised of a cup with an elongated and curved opening for closely fitting under and against a vulva. The male funnel is comprised of a penis-shaped tube with a resilient sealing ring around an open end for sealing around an inserted penis. The funnel can be positioned against the body through a fly in the pants, through a loosened waistband, or under a dress. Urine deposited in the funnel is rapidly drawn into the container by the pump even when the funnel and the top end of the tube are angled up and define an initially uphill path for the urine, such as when the user is seated.

5 Claims, 2 Drawing Sheets

PUMP AUGMENTED URINE COLLECTOR

BACKGROUND OF THE INVENTION

1. Field of the Invention

This invention relates generally to devices that enable a person to urinate without undressing.

2. Prior Art

People often need to urinate when they are unable to find a toilet, for example, when they are hiking, camping, or traveling in a car. When restrooms are found, they are often highly unsanitary gas station or other public restrooms. Even when a public restroom is available but relatively distant, some people would like to be able to urinate without having to walk to the restroom.

Various urine collectors are known among the prior art that enable people to urinate anywhere. One type of collector is comprised of a container with an integral rigid funnel. Since the user must drop his or her pants and position it under the crotch, it cannot be used in a seated position or where subject to possible public view, which severely limits its usefulness. Another type of collector designed for female use is comprised of a funnel attached to a bag with a flexible hose. The entire device can be slipped inside the clothing; however, the user must be standing to let the urine drain from the funnel into the container. If the user is in a seated position, especially on a car seat which is tilted slightly upward at the front, the funnel and hose will be angled upward and prevent the urine from draining into the container. Urinating in a seated position can result in much of the urine spilling, thus creating a mess and an embarrassing situation.

OBJECTS OF THE INVENTION

The objects of the present urine collector are:

to enable a user to urinate without undressing;

to enable a user to urinate discreetly in a private space, such as a car, without anyone noticing; and to enable a user to urinate in a seated position without spillage.

Further objectives of the present invention will become apparent from a consideration of the drawings and ensuing description.

BRIEF SUMMARY OF THE INVENTION

A urine collector is comprised of a container with an electric suction pump. A hose extending from the pump is connected to a funnel for collecting urine. The funnel is comprised of an interchangeable female or male funnel. The female funnel is comprised of a cup with an elongated and curved opening for closely fitting under and against a vulva. The male funnel is comprised of a penis-shaped tube with a resilient sealing ring around an open end for sealing around an inserted penis. The funnel can be arranged to engage the body through a fly in the pants, through a loosened waistband, or under a dress. Urine deposited in the funnel is rapidly drawn into the container by the pump even when the funnel and the top end of the tube are angled up and define an initially uphill path for the urine, such as when the user is seated.

DRAWING REFERENCE NUMERALS

| | |
|---|---|
| 10. Pump Housing | 11. Suction Pump |
| 12. Collection Container | 13. Switch |
| 14. Battery | 15. Cigarette Lighter Plug |
| 16. Handle | 17. Hose |
| 18. Female Funnel | 19. Male Funnel |
| 20. Storage Compartment | 21. Hinged Cover |
| 22. Drain Plug | 23. Pump Housing |
| 24. Suction Pump | 25. Collection Container |
| 26. Switch | 27. Battery |
| 28. Cigarette Lighter Plug | 29. Handle |
| 30. Hose | 31. Female Funnel |
| 32. Notch | 33. Opening |
| 34. Curved Contour | 35. Drain Plug |
| 36. Cup | 37. Double Wall |
| 38. Chamber | 39. Drain Hole |
| 40. Inner Wall | 41. Screen |
| 42. Tube | 43. Sealing Ring |
| 44. Open Rear End | 45. Resilient Tube |
| 46. Rigid Tube | 47. Double Wall |
| 48. Chamber | 49. Drain Holes |
| 50. Sealing Strip | 51. Inner Wall |

DETAILED DESCRIPTION OF THE INVENTION

Figure 1:
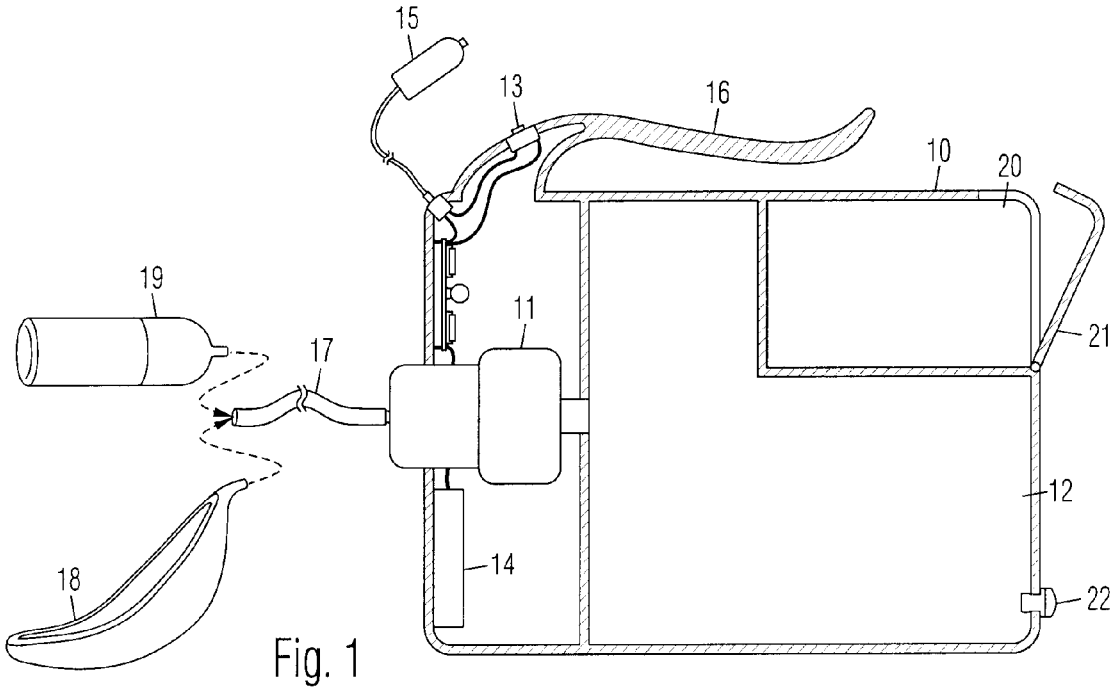
FIG. 1 is a cutaway view of the present urine collector.

FIG. 1:

A first embodiment of the present urine collector is shown in a side cutaway view in FIG. 1. It is comprised of a pump housing 10 with an electric suction pump 11 connected to a urine collection container 12. An on/off switch 13 is connected between a battery 14 and pump 11, and between a cigarette lighter plug 15 and pump 11. Plug 15 may be used when in a car to conserve battery 14, or when battery 14 is dead. A handle 16 is attached to housing 10. Switch 13 is preferably positioned in handle 16 for easy reach. A hose 17 has a proximal end connected to pump 11 and a distal end attachable to either a female funnel 18 or a male funnel 19. A storage compartment 20 with a hinged cover 21 is provided in housing 10 for storing the funnels when they are not in use. A drain plug 22 is provided at the bottom of container 12.

Female funnel 18 and male funnel 19 are each arranged for being pressed against the crotch of a user for collecting urine. Pump 11 is started prior to urinating into either funnel. Urine deposited in the funnel is rapidly drawn into container 12 by pump 11. Even if the funnel and the top end of hose 17 are angled upward to define an uphill path for the urine, such as when the user is seated, the urine is still positively drawn from the funnel by pump 11. The pumping rate of pump 11 should be greater than the highest anticipated urination rate to avoid spillage.

Figure 2:
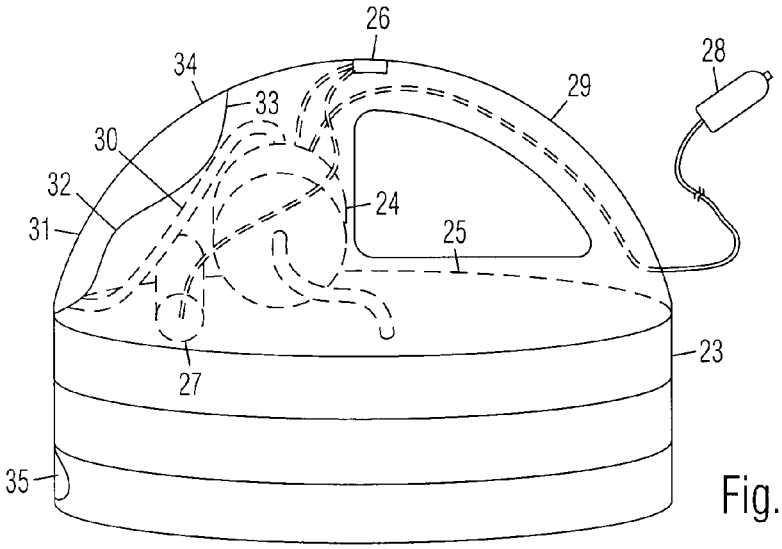
FIG. 2 is a side perspective view of a second embodiment thereof.

FIG. 2:

A second embodiment of the urine collector is shown in a side perspective view in FIG. 2. It is comprised of a pump housing 23 with an electric suction pump 24 connected to a urine collection container 25. Pump housing 23 preferably has a rounded top contour. An on/off switch 26 is connected between a battery 27 and pump 24, and between a cigarette lighter plug 28 and pump 24. A handle 29 is attached to housing 23. Switch 26 is preferably positioned in handle 29 for easy reach. A hose 30 is connected between pump 24 and a female funnel 31. A storage notch 32 is provided on housing 23 for storing female funnel 31 when it is not in use. Notch 32 is shaped for mating with an opening 33 of funnel 31 when funnel 31 is inverted. When female funnel 31 is attached to notch 32, a continuously curved contour 34 is formed by inverted female funnel 31 and housing 23. A male funnel can also be connected to the end of hose 30, and a storage compartment may be provided in the housing for the male funnel. A drain plug 35 is provided at the bottom of container 25.

Figure 3:
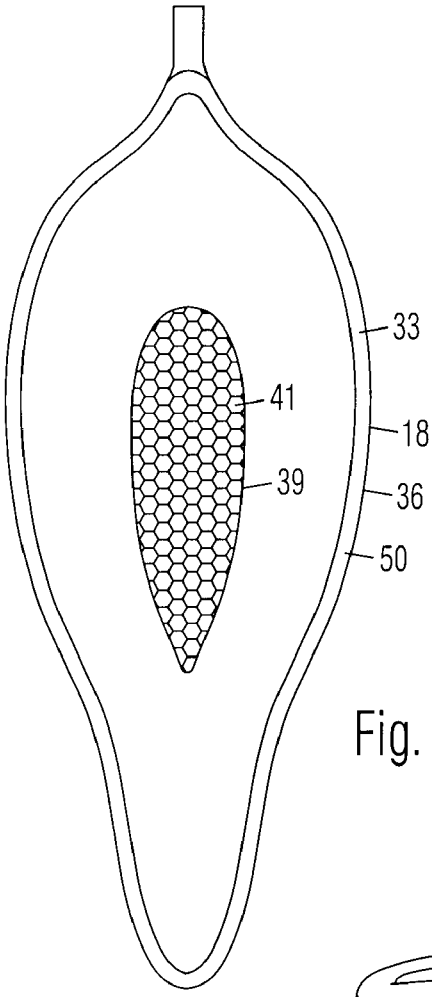
FIG. 3 is a top view of a female funnel thereof.
Figure 4:
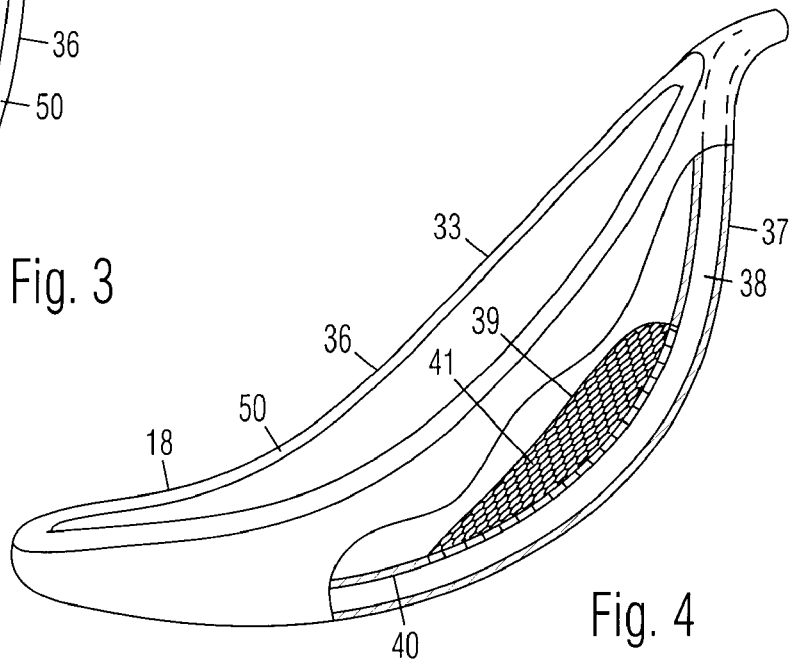
FIG. 4 is a cutaway side perspective view of the female funnel.
Figure 5:
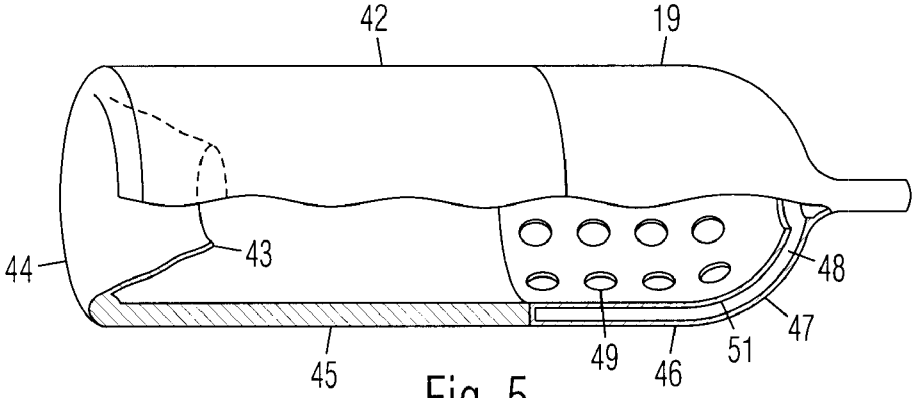
FIG. 5 is a cutaway side perspective view of a male funnel thereof.

FIGS. 3–4:

Female funnel 18 is shown in a top view in FIG. 3 and a side cutaway view in FIG. 4. It is comprised of a cup 36 with an opening 33 which is elongated when seeing in a top view, and curved when seen in a side view for closely fitting under a vulva. Cup 36 has a double wall 37 that defines an interior chamber 38 which is communicably connectable to the hose at a front end of cup 36. A drain hole 39 is positioned at the bottom of an inner wall 40 for draining urine into chamber 38. A screen 41 is positioned across drain hole 39. A resilient sealing strip 50 is arranged around opening 33. Alternatively, hose 17 (FIG. 1) may be connected near a rear end of cup 36. Also, the double wall maybe replaced by a single wall and the hose may be connected to a bottom of cup 36. The urine collector can thus be used by a woman without undressing by positioning female funnel 18 through clothing, such as through a loosened waistband, or under a dress and into her underwear.

FIG. 5:

Male funnel 19 is comprised of a penis-shaped tube 42 with a resilient, inwardly tapered conical sealing ring 43 around an open end 44 for sealing around a penis. A rear portion of penis-shaped tube 42 is comprised of a resilient tube 45 for further ensuring a seal around the penis. A front portion of penis-shaped tube 42 is comprised of a rigid tube 46 with a double wall 47 that defines an interior chamber 48 which is communicably connectable to the hose at the front of penis-shaped tube 42. Drain holes 49 are distributed around an inner wall 51 for draining urine into chamber 48. The urine collector can be used by a man without undressing by positioning male funnel 19 through clothing, such as a fly in a pair of pants.

Alternatively, the entire collector can be made small enough to be worn under clothing to enabling urination without anyone noticing. For example, the pump housing can be worn around the lower leg, the hose can be positioned along a leg, and the funnel can be strapped to the body.

SUMMARY AND SCOPE

Accordingly, the present pump augmented urine collector enables a user to urinate without undressing. It enables a user to urinate without anyone noticing. It also enables a user to urinate in a seated position without spillage.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A urine collector, comprising:

a funnel for being pressed against a crotch of a user for collecting urine;

a hose with a distal end connected to said funnel;

a suction pump connected to a proximal end of said hose for sucking said urine from said funnel even when said user is seated and a distal portion of said hose defines an initially uphill path for said urine;

a urine collection container connected to said suction pump for collecting said urine; and a housing enclosing said suction pump and said collection container, and a storage compartment in said housing with a hinged cover for storing said funnel when said funnel is not in use.

2. A urine collector, comprising:

a funnel for being pressed against a crotch of a user for collecting urine;

a hose with a distal end connected to said funnel;

a suction pump connected to a proximal end of said hose for sucking said urine from said funnel even when said user is seated and a distal portion of said hose defines an initially uphill path for said urine;

a urine collection container connected to said suction pump for collecting said urine;

a housing enclosing said suction pump and said collection containers;

a handle attached to said housing; and an on/off switch connected to said suction pump and positioned on said handle for facilitating operation while a user is gripping said handle.

3. A urine collector, comprising:

a female funnel for being pressed against a vulva of a female user for collecting urine, wherein said female funnel is comprised of a cup with an opening which is elongated when seen in a top view, and curved when seen in a side view for closely fitting under said vulva;

a hose with a distal end connected to said funnel;

a suction pump connected to a proximal end of said hose for sucking said urine from said funnel even when said user is seated and a distal portion of said hose is angled upward and defines an initially uphill path for said urine;

a urine collection container connected to said suction pump for collecting said urine;

a pump housing enclosing said suction pump and said collection container, wherein said pump housing includes a rounded top contour; and a storage notch on said pump housing for storing said female funnel when said female funnel is not in use, wherein said storage notch is shaped for mating with said opening of said female funnel when said female funnel is inverted, and when said female funnel is attached to said storage notch, a continuously curved contour is formed by an inverted bottom of said female funnel and said top contour of said pump housing.

4. A urine collector, comprising:

a funnel for being pressed against a crotch of a user for collecting urine;

a hose with a distal end connected to said funnel;

a suction pump connected to a proximal end of said hose for sucking said urine from said funnel even when said user is seated and a distal portion of said hose defines an initially uphill path for said urine; and a urine collection container connected to said suction pump for collecting said urine;

wherein said funnel is comprised of a cup with an opening which is elongated when seeing in a top view, and curved when seen in a side view for closely fitting under a vulva, said cup includes a double wall that defines an interior chamber which is communicably connected to said distal end of said hose, a drain hole at a bottom of an inner wall for draining said urine into said interior chamber, a screen across said drain hole, and a resilient sealing strip around said opening.

5. A urine collector, comprising:

a funnel for being pressed against a crotch of a user for collecting urine;

a hose with a distal end connected to said funnel;

a suction pump connected to a proximal end of said hose for sucking said urine from said funnel even when said user is seated and a distal portion of said hose defines an initially uphill path for said urine; and a urine collection container connected to said suction pump for collecting said urine;

wherein said funnel is comprised of a penis-shaped tube with a resilient, inwardly tapered conical sealing ring around an open end for sealing around a penis, a rear portion of said penis-shaped tube adjacent said open end is comprised of a resilient tube for further ensuring a seal around said penis, a front portion of said penis-shaped tube is comprised of a rigid tube with a double wall that defines an interior chamber which is communicably connectable to said hose, said penis-shaped tube further including drain holes around an inner wall for draining said urine into said chamber.

* * * * *